US007574760B2

(12) United States Patent
Foley et al.

(10) Patent No.: US 7,574,760 B2
(45) Date of Patent: Aug. 18, 2009

(54) CUSHIONING SYSTEM WITH PARALLEL SHEETS HAVING OPPOSING INDENTIONS FOR LINEAR DEFLECTION UNDER LOAD

(75) Inventors: Peter Foley, Castle Rock, CO (US); Gerald Michael (Mike) Buchen, Parker, CO (US); Adam Lyons, Denver, CO (US); Timothy Patrick Pepe, Centennial, CO (US)

(73) Assignee: Skydex Technologies, Inc., Englewood, CO (US)

( * ) Notice: Subject to any disclaimer, the term of this patent is extended or adjusted under 35 U.S.C. 154(b) by 529 days.

(21) Appl. No.: 11/326,122

(22) Filed: Jan. 5, 2006

(65) Prior Publication Data

US 2006/0277685 A1 Dec. 14, 2006

Related U.S. Application Data

(60) Provisional application No. 60/641,412, filed on Jan. 5, 2005.

(51) Int. Cl.
*A47C 7/35* (2006.01)
*A47C 27/05* (2006.01)

(52) U.S. Cl. ..... 5/655.7; 5/719; 5/654.1; 267/164; 267/142

(58) Field of Classification Search ..... 5/653, 5/654, 654.1, 655.7, 655.9, 719, 721, 740; 267/142–145, 81, 103, 107, 164, 165; 36/29, 36/35 B See application file for complete search history.

(56) References Cited

U.S. PATENT DOCUMENTS

| | | | | | |
|---|---|---|---|---|---|
| 2,433,012 | A * | 12/1947 | Zalicovitz | ..... | 5/247 |
| 2,434,641 | A * | 1/1948 | Burns | ..... | 267/117 |
| 3,280,410 | A * | 10/1966 | Propst et al. | ..... | 267/119 |
| 3,618,144 | A * | 11/1971 | Frey et al. | ..... | 5/247 |
| 5,572,804 | A * | 11/1996 | Skaja et al. | ..... | 36/29 |
| 5,787,533 | A * | 8/1998 | Fromme | ..... | 5/719 |
| 6,189,168 | B1 * | 2/2001 | Graebe | ..... | 5/644 |
| 6,353,953 | B1 * | 3/2002 | Tanaka et al. | ..... | 5/723 |
| 6,931,685 | B2 * | 8/2005 | Kuchel et al. | ..... | 5/716 |

* cited by examiner

*Primary Examiner*—Michael Trettel
(74) *Attorney, Agent, or Firm*—Wong, Cabello, Lutsch, Rutherford & Brucculeri, LLP

(57) ABSTRACT

A cushion comprises a first surface made of flexible high polymer resin; a second surface made of flexible high polymer resin, in at least partially coextensive relation to the first surface to define a cavity therebetween, the coextensive relation defining opposing corresponding portions of the first and second surfaces; a plurality of support members comprising inwardly directed indentations in both of the first and second surfaces extending into the cavity, a plurality of the indentations in each of the first and second surfaces having a square shape and an outwardly facing recess, a plurality of the indentations in the first surface abutting the indentations in the second surface; a layer of viscoelastic foam substantially overlying the first surface; and, a fabric enclosure surrounding the first surface, the second surface and the foam layer.

6 Claims, 14 Drawing Sheets

Covered Seat Cushion – Prototype – Top View

Covered Seat Cushion – Prototype – Close-up View

Covered Seat Cushion – Prototype – Side View

Hemi-ellipsoidal springs have a non-linear force-deflection curve due to "buckling" of the plastic.
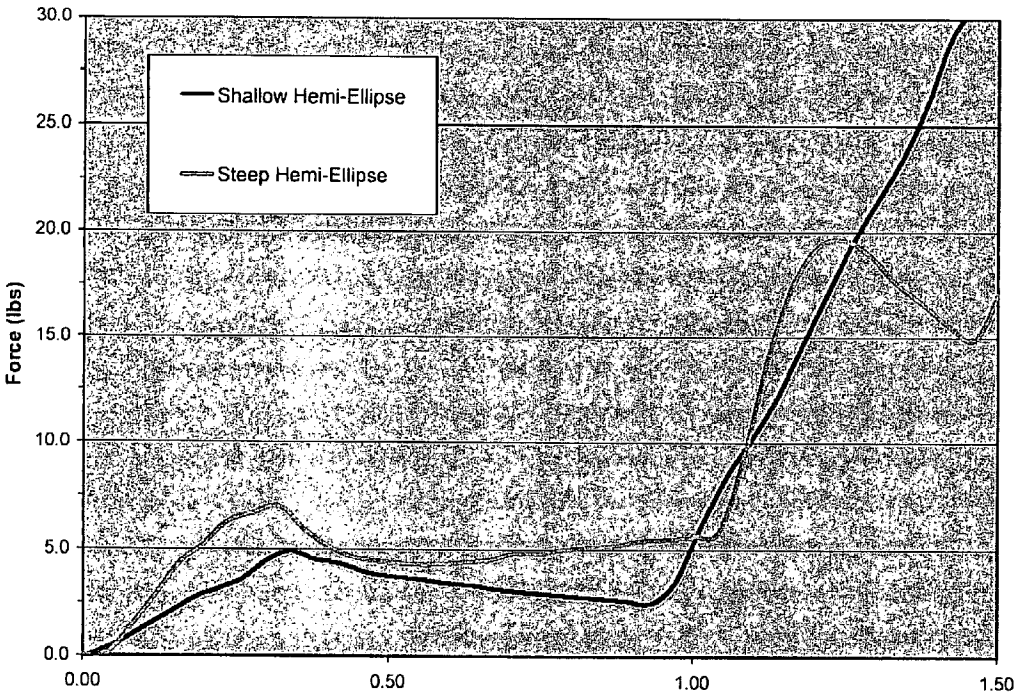
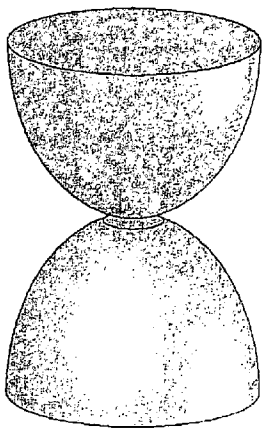
A
B
3
December, 2004
Figure 9
prior art
SKYDEX Smarter Cushioning

- SKYDEX Square: engineered for comfort applications versus SKYDEX hemi-ellipsoid engineered for high shock attenuation
- Offers the benefits of SKYDEX hemi-ellipses without the buckle
- Force-deflection data has shown that the SKYDEX square shape approaches a linear force-deflection curve. Initial testing of 2.0 square shape proved linearity.

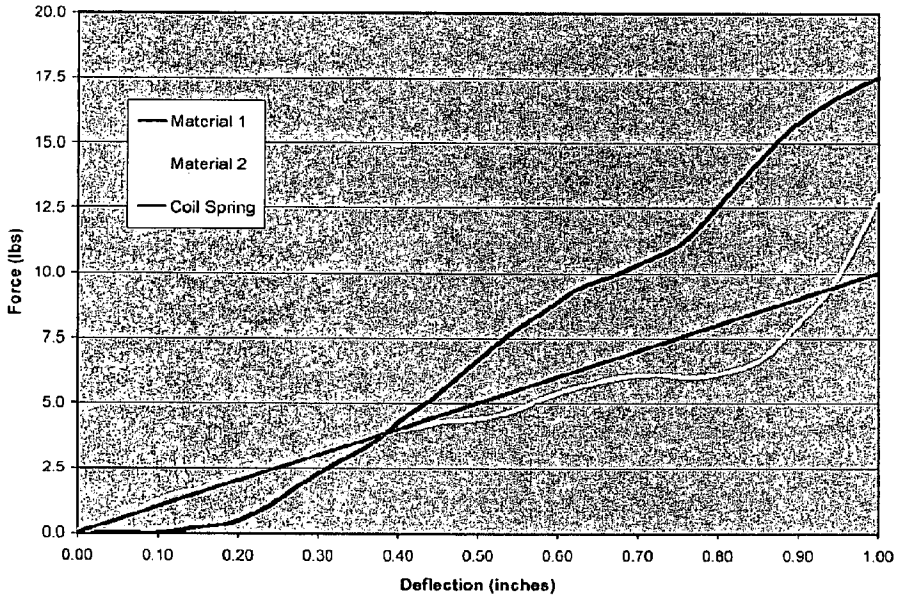

B

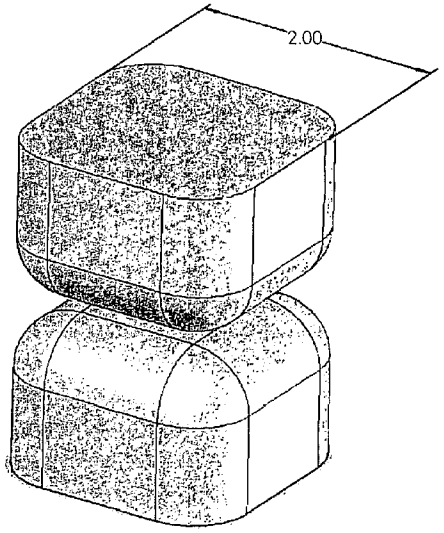

A

SKYDEX Smarter Cushioning

December, 2004

Figure 10

Comparison of SKYDEX Square Shape to Hemi-Ellipse Shape

5

December, 2004

SKYDEX Smarter Cushioning

Tunable Geometry: SKYDEX squares

- Engineering variables for tuning SKYDEX square compression
  - Material type
  - Material thickness
  - Square size
  - Height
  - Radius on mating surface
  - Could include imbedded hemi for added stiffness
  - Radii on corners SKYDEX Smarter Cushioning December, 2004

Square Schematic

Variables in linear F/D curve analysis:

W = Width

H = Wall Height

R = Radius

Material

Film Thickness

SKYDEX Smarter Cushioning

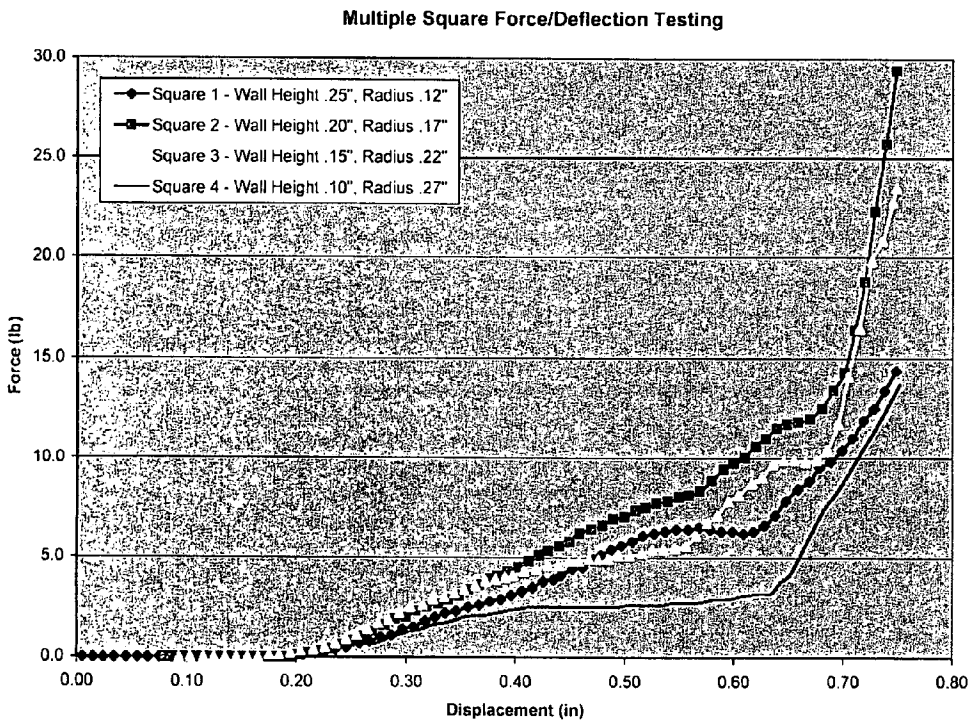

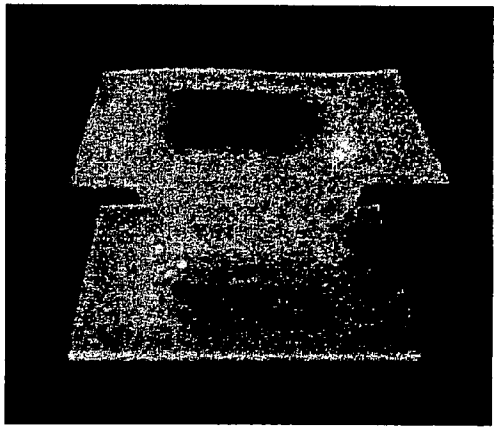

Initial testing was completed on small square samples that measured W = 1.00" by varying the wall height (H) and the joining radius (R). The figure above shows the results of this testing.

As the wall height and radius was varied, the force/deflection curves were charted and a linear curve started to become apparent.

The dimensions for Square 2 were ratioed up to a larger square shape.

SKYDEX
Smarter Cushioning

Figure 14

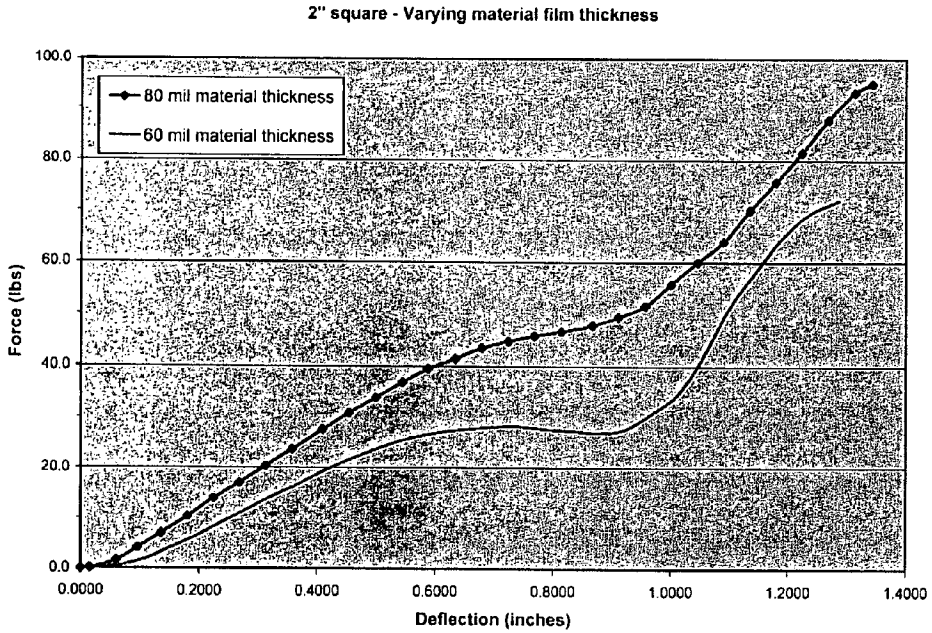

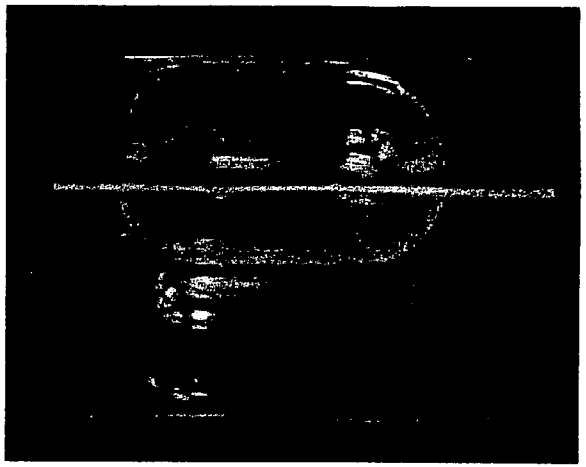

New square shapes were created that measured: W = 2.0", H = .30" , R = .45"

Force/deflection data was taken on this new shape to prove the linear curve.

Varying film thicknesses were tested and the above figure represents two different thicknesses on the 2.0" square shape showing that film thickness is another variable to take into consideration when evaluating the linear force/deflection properties of these shapes.

SKYDEX
Smarter Cushioning™

Figure 15

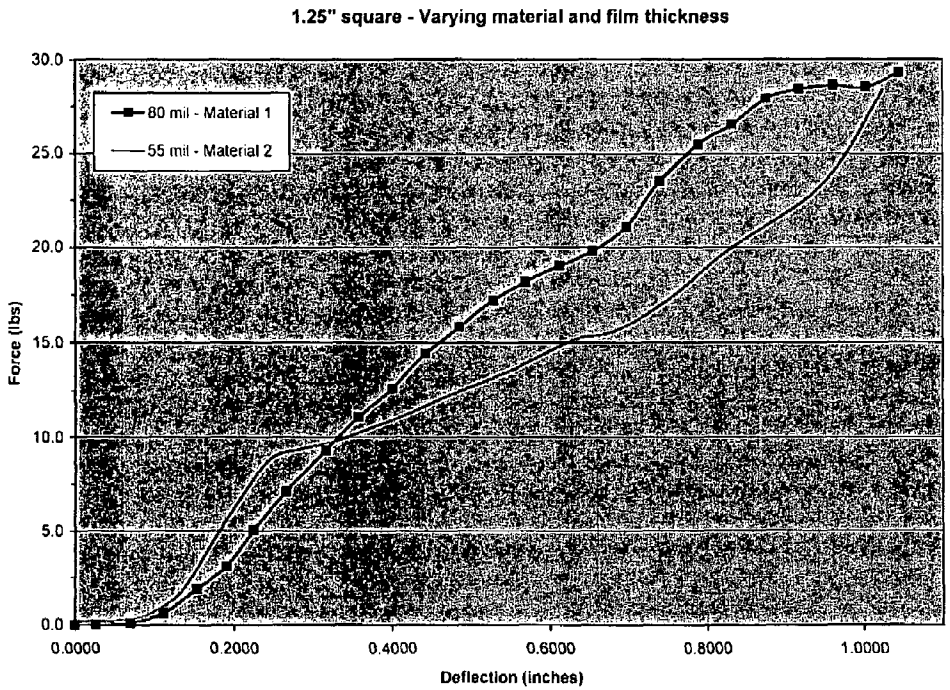

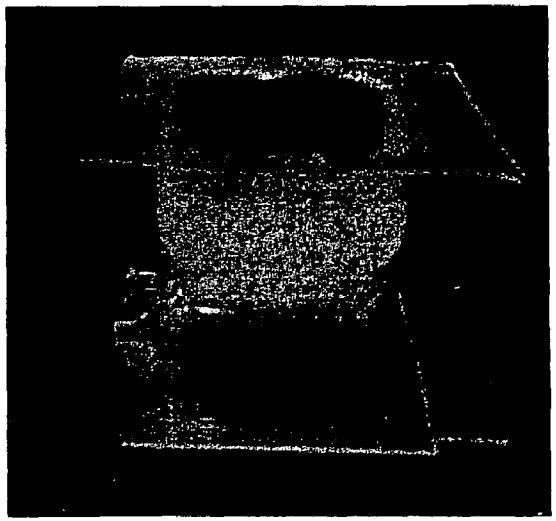

A third iteration of the square shape was modeled that measured W = 1.25", H = .47" , R = .28"

Force/deflection data was also taken here to verify a linear curve.

The type of material is a fifth variable that was tested and the above figure represents force/deflection data taken while altering the type of material and the film thickness. In both cases a nearly linear curve was represented.

SKYDEX
Smarter Cushioning

Figure 16

CUSHIONING SYSTEM WITH PARALLEL SHEETS HAVING OPPOSING INDENTIONS FOR LINEAR DEFLECTION UNDER LOAD

CROSS-REFERENCE TO RELATED APPLICATIONS:

This application claims priority under 60/641,412, filed Jan. 5, 2005, which is incorporated herein by reference in its entirety.

BACKGROUND OF THE INVENTION

1. Field of the Invention

This invention relates to cushioning systems, materials and methods. The cushioning system of the invention may be used for any comfort-related cushioning application including, but not limited to, mattresses, furniture cushioning, body padding, footwear and packaging. One exemplary embodiment is a portable seat cushion designed to be easily moved from one seating surface to another by the user.

2. Description of the Related Art

In the past, portable seat cushions have commonly been constructed using one or more pieces of foam contained within a plastic or fabric enclosure. These products typically use a low-density foam that, after several hours of operation, provide little or no comfort layer for the user because the foam has compressed too much and will not return to its original shape.

More recently, a novel plastic cushioning material developed by Skydex Technologies, Inc. (Centennial, Colo.) has come into use for footwear and body protective gear. This material and its method of fabrication are disclosed in the following U.S. patents: U.S. Pat. No. 6,098,313 "Shoe sole component and shoe sole component construction method" U.S. Pat. No. 6,029,962 "Shock absorbing component and construction method" U.S. Pat. No. 5,976,451 "Construction method for cushioning component" and U.S. Pat. No. 5,572,804 "Shoe sole component and shoe sole component construction method."

BRIEF SUMMARY OF THE INVENTION

The invention provides for a cushioning system that combines a SKYDEX flexible plastic cushioning material layer and a visco-elastic foam layer. In one preferred embodiment, both layers are enclosed in a moisture resistant bag. The SKYDEX plastic cushioning material layer provides a nearly linear force-deflection curve which allows for maximum comfort throughout the compression and shock cycle. The foam layer, which may be the top layer and closest to the user, acts as the comfort layer between the user and the SKYDEX layer. For a seating application, the foam may be contoured to match the user's buttocks area, which provides for proper positioning when using the product. In other applications, the foam may be shaped in other ways so as to spread the contact surface as greatly as possible. The invention is portable, and handles may be provided on one or more sides of the bag, for the user to move the product with them in and out of each system they are using the product in, which could be, but not limited to, a vehicle, an aircraft, an office seat, a boat, etc. The bag may be made from a heavy-duty upholstery fabric such as Cordura® fabric that can be expected to withstand many hours of use, as well as providing for a moisture resistant layer to keep moisture away from the foam and SKYDEX. The bag of Cordura fabric is also resistant to tears or punctures. The SKYDEX layer of the combination allows for air and moisture flow through the layer and is generally easier to clean than foam.

BRIEF DESCRIPTION OF THE DRAWING FIGURES

FIG. 9A is a perspective view of a pair of hemi-ellipsoidal SKYDEX springs of the prior art.

FIG. 9B is a graph depicting force versus deflection curves for two different configurations of the prior art hemi-ellipsoidal SKYDEX springs shown in FIG. 9A.

FIG. 10A is a perspective view of a pair of square type SKYDEX springs according to the present invention.

FIG. 10B is a graph depicting force versus deflection curves for a coil spring and two different square SKYDEX springs according to the configuration shown in FIG. 10A.

FIG. 14 is a graph showing the force versus displacement curves for square-type SKYDEX materials having various wall heights and radii.

FIG. 15 is a graph showing the force versus deflection curves of two square-type SKYDEX materials having different material thickness.

FIG. 16 is a graph showing the force versus deflection curves of two square-type SKYDEX materials having different material thickness and different size compared to that of FIG. 15.

DETAILED DESCRIPTION OF THE INVENTION

Figure 1:
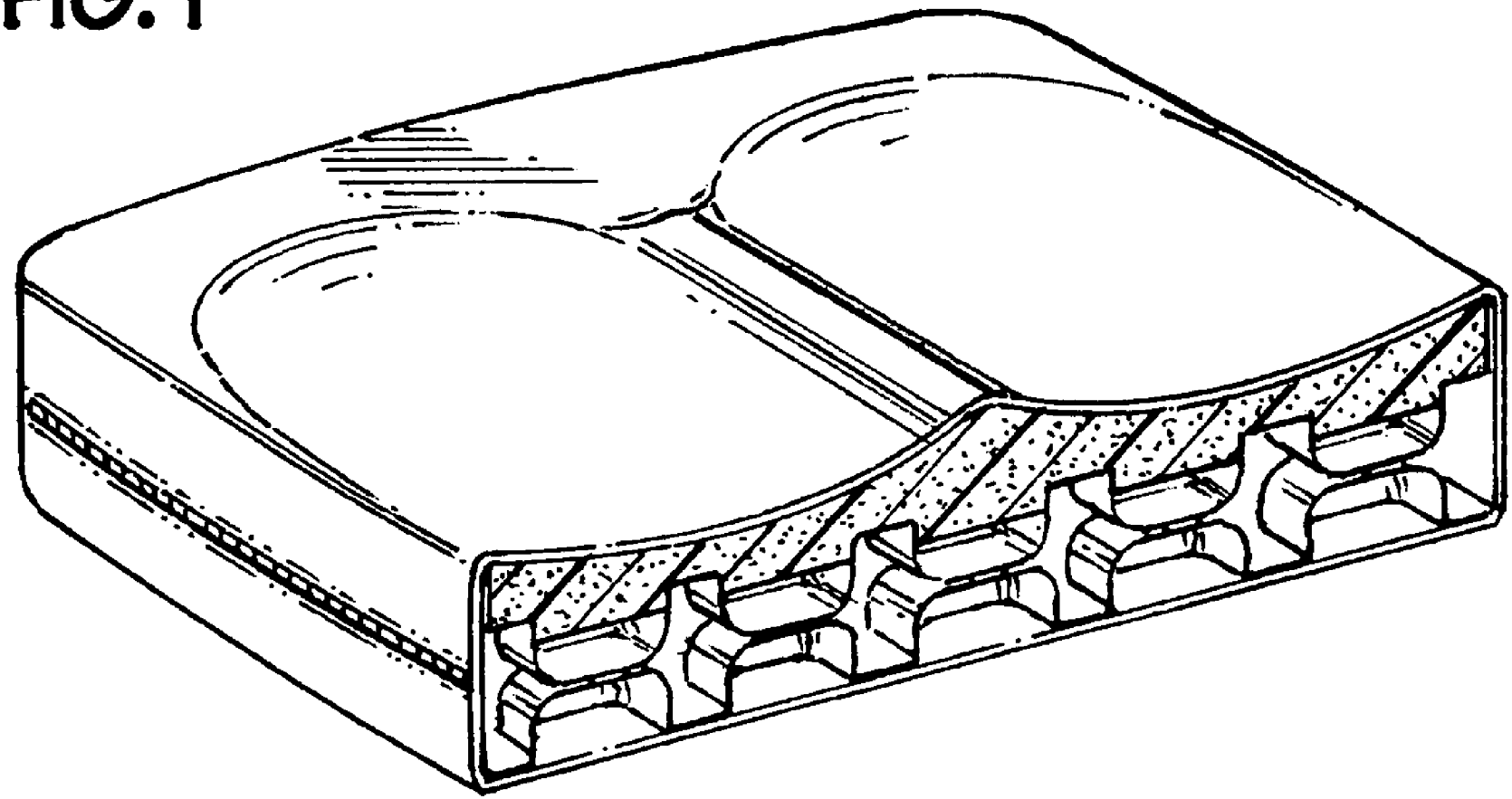
FIG. 1 is a cross-sectional view of one embodiment of the invention.
Figure 2:
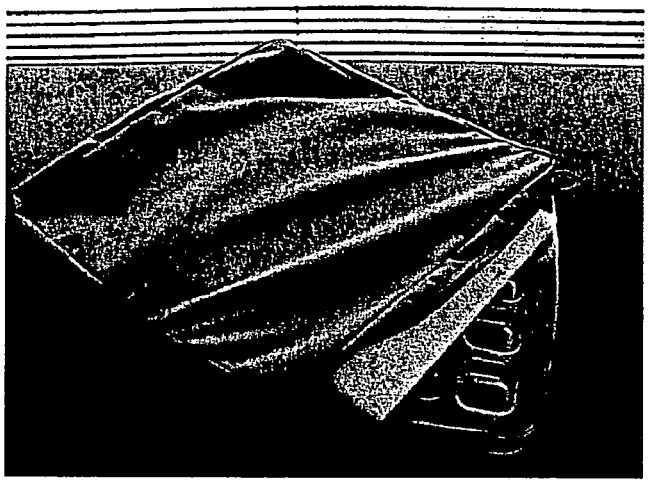
FIG. 2 is a top view photograph of a partially disassembled embodiment.
Figure 3:
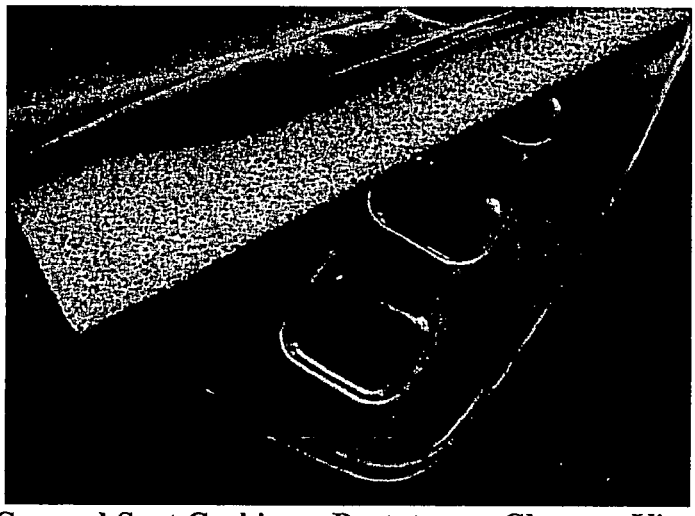
FIG. 3 is a close up photograph of the embodiment shown in FIG. 2.
Figure 4:
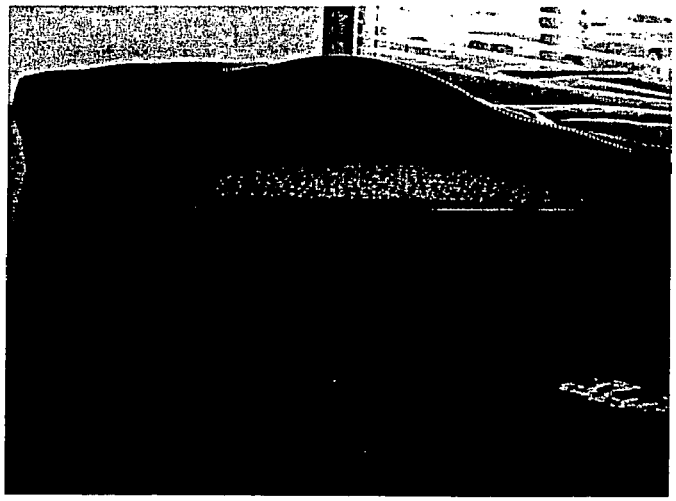
FIG. 4 is a side-view photograph of the embodiment shown in FIG. 2 with the outer covering opened to expose the cushioning layers.
Figure 5:
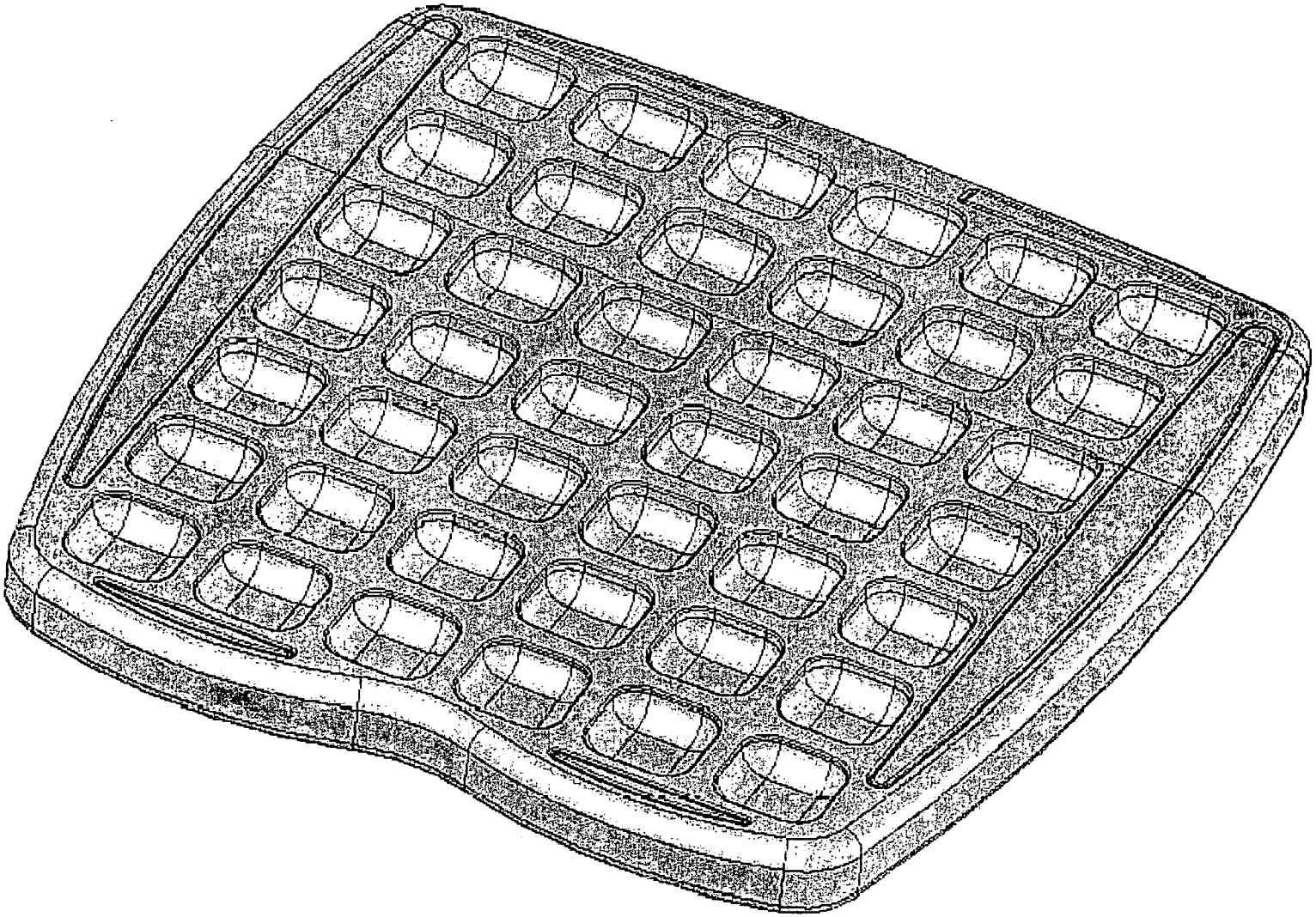
FIG. 5 is an isometric view of an alternative embodiment of the invention.
Figure 6:
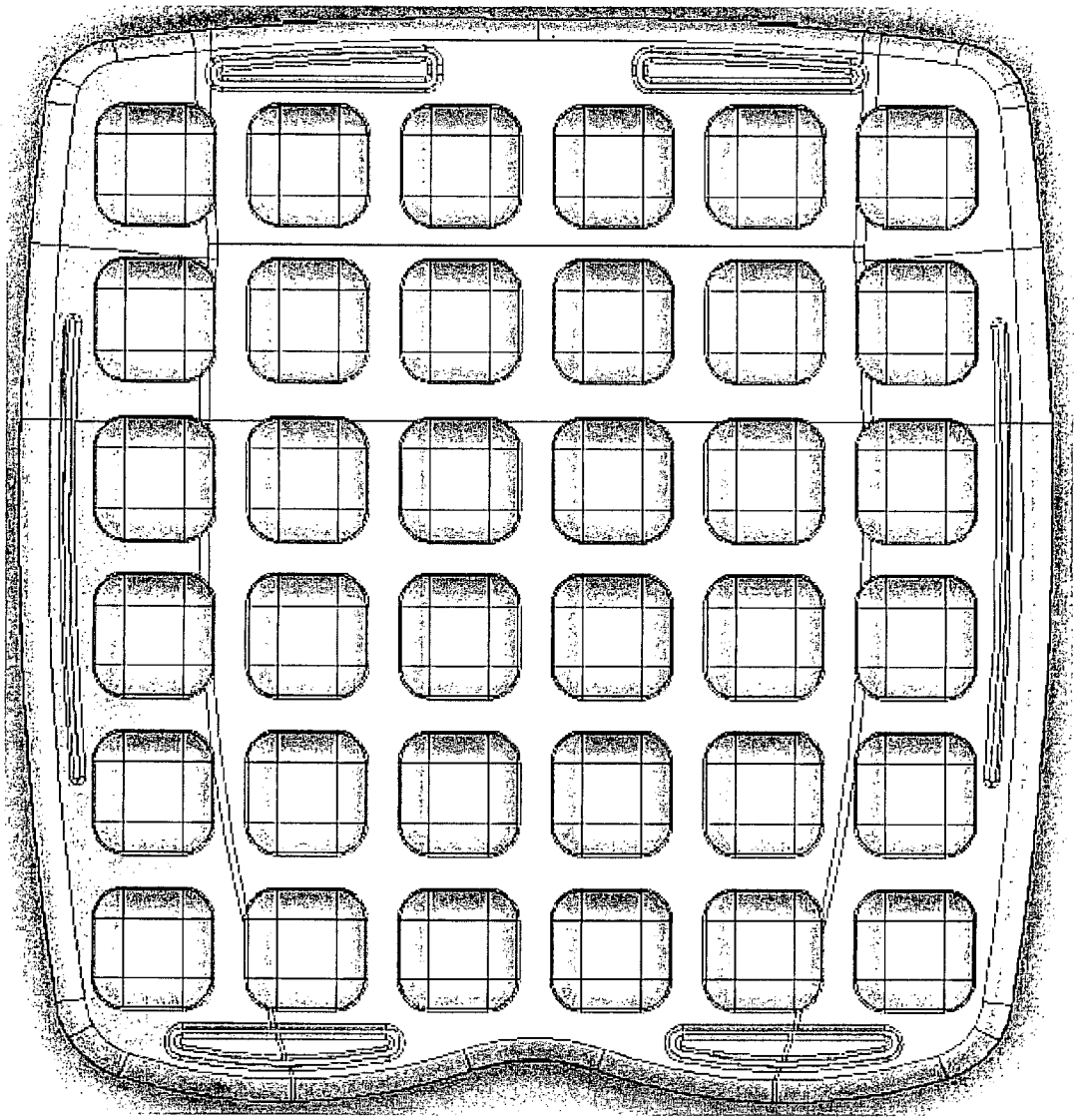
FIG. 6 is a top plan view of the embodiment illustrated in FIG. 5.
Figure 7:
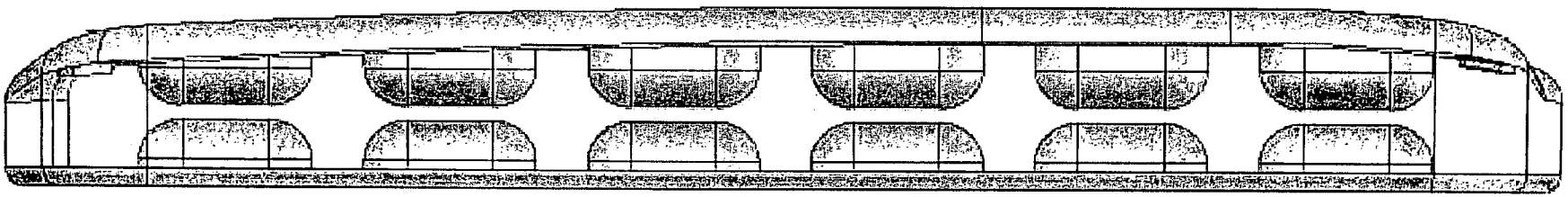
FIG. 7 is a side view of the embodiment illustrated in FIG. 5.

Referring to FIG. 1, one preferred embodiment of the invention is shown wherein a lower layer of SKYDEX® linear-response plastic cushioning material and an upper layer of formed visco-elastic foam are encased in a fabric bag.

The upper surface of the foam layer is molded to conform to an adult human's buttocks when in a seated position. The lower surface of the foam layer is molded to mate with the upper surface of the SKYDEX linear-response plastic cushioning material.

The bag or enclosure may be formed of any suitable material including vinyl plastic, fabric reinforced plastic, and upholstery fabric. One particularly preferred upholstery material is CORDURA® fabric developed by E. I. du Pont de Nemours and Company (Wilmington, Del.) and available from Invista North America S.A.R.L. Corporation (Wilmington, Del.). The bag may be provided with one or more openings having a closure device such as a zipper or VELCRO hook-and-loop type fasteners to facilitate the insertion and removal of the cushioning materials. Moisture-resistant materials are particularly preferred for the bag so as to prevent water from infiltrating the cushioning layers.

A particularly preferred cushioning material comprises two thermoformed sheets of plastic that, when formed with a cavity of a particular geometry, mimic a linear spring when compressed. The seat cushioning material has square cavities on the top and bottom of two sheets of plastic that are joined at the middle of the product (see FIGS. 1-7). The square depressions are rounded on the bottom while the sides are straight. The seat cushioning material has a contoured shape to better fit the user and the seat. The square cavities allow for compression to occur in a linear force/deflection environment when a user sits on the cushion. The straight walls of the square indentations compress evenly on both sides of the plastic, providing for this linear curve. The preferred method of construction is to twin-sheet thermoform the plastic material because of speed and cost. This method will form and adhere the two pieces together in one operation.

Figure 8:
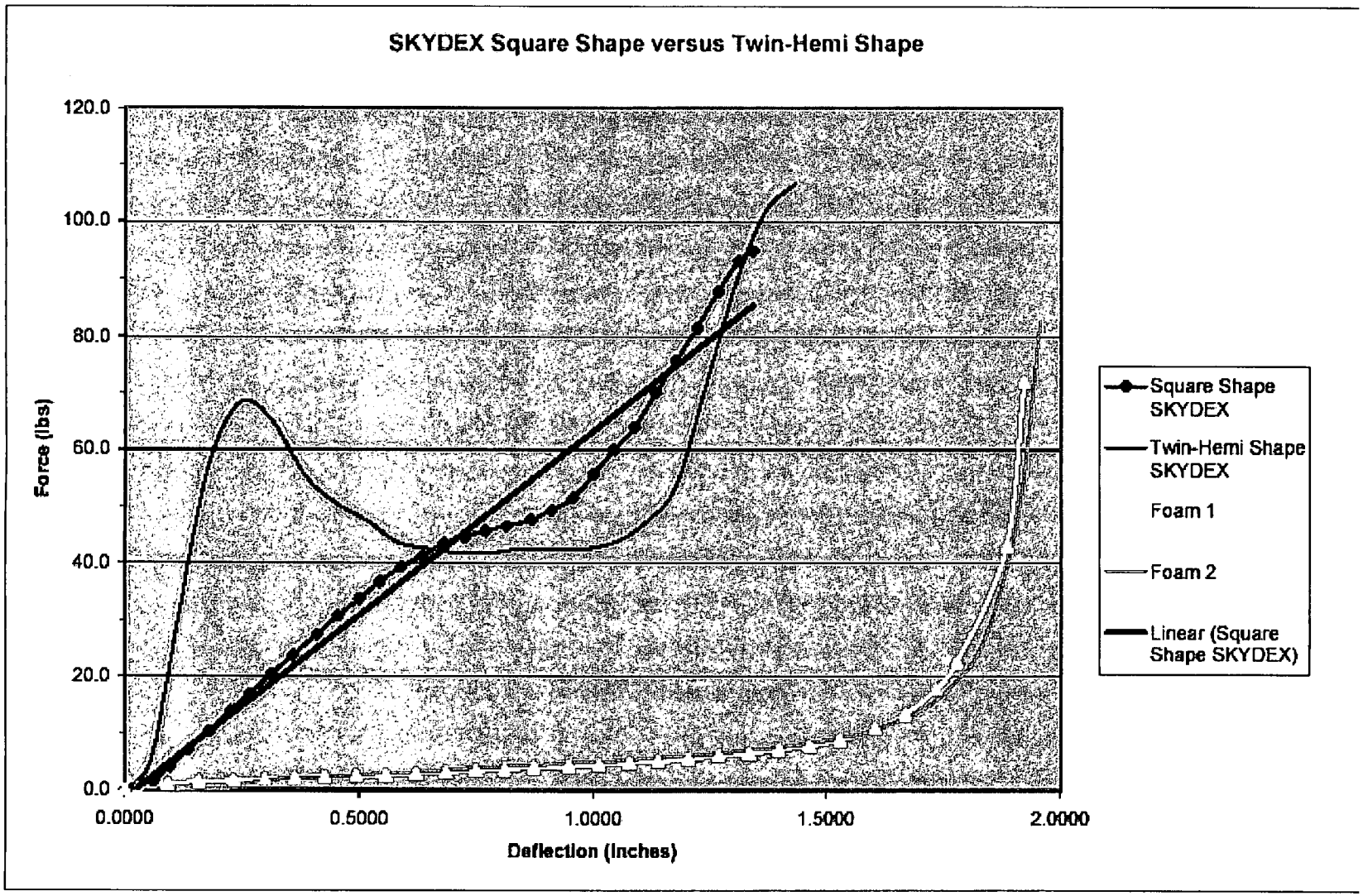
FIG. 8 are force vs. deflection curves for two different SKYDEX materials and two different foam materials.

This invention allows for a linear force-deflection curve for the majority of the deflection that is seen when a person compresses the product. FIG. 8 shows a square shaped SKYDEX material geometry (dark blue line) and a twin-hemi shaped SKYDEX material geometry (pink line). The Linear line (black) is on the chart to represent the linear curve that the square geometry follows. What is shown is that the square indentation follows the linear curve more closely than the SKYDEX material using hemispheres, which provides a greater comfort feel than the non-linear twin-hemi curve. The other two curves on the chart represent two different types of foam that were tested, that both have an exponential force-deflection curve. Having a product with a linear force deflection curve minimizes the pressure points that are felt by the subject when using the product and allows for greater comfort. Another way to think of comfort is in terms of a mattress, which uses coil springs in its internal system. Coil springs typically have a linear force-deflection curve.

Other products (like different types of foams) provide for an exponential force-deflection curve during compression. This can place pressure points on areas of the buttocks that cause discomfort when sitting on the cushion for long periods of time. A seat cushion with a linear force-deflection curve can minimize this discomfort and reduce pressure points.

Alternative forms of SKYDEX cushioning technology can also work in this invention for example by providing an internal hemisphere at the bottom of the square depression. The added hemisphere supports the square cavity at the same point that this buckling occurs, thereby increasing the steepness of the curve and producing a more nearly linear response curve.

Alternative methods of construction include vacuum forming or single sheet thermoforming. Both of these methods may require the two sheets of plastic to be secured via a secondary operation such as, but not limited to: sonic welding or hot gun welding.

FIG. 9B is a plot of force (in pounds) versus deflection (in inches) for two different SKYDEX hemi-ellipsoidal springs. Curve #1 (shown in red) is for a shallow profile hemi-ellipse spring. Curve #2 is for a steep profile hemi-ellipse spring. It will noted that both of these springs have a non-linear force-deflection curve due to "buckling" of the plastic which, in the examples illustrated, begins at about 0.3 inch of deflection.

FIG. 10B illustrates the more nearly linear response obtained with a square type SKYDEX spring (as shown in FIG. bA). Curve #1 (black line) is for square SKYDEX material fabricated using a first elastomer. Curve #2 (shown in yellow) is for square SKYDEX material fabricated using a second elastomer. For comparison purposes, the linear force versus displacement curve of a coil spring is shown as Curve #3 (shown in red). It will be noted that the force versus deflection curve of the square SKYDEX material fabricated from elastomer material 2 closely approximates the linear response of a coil spring.

Figure 11:
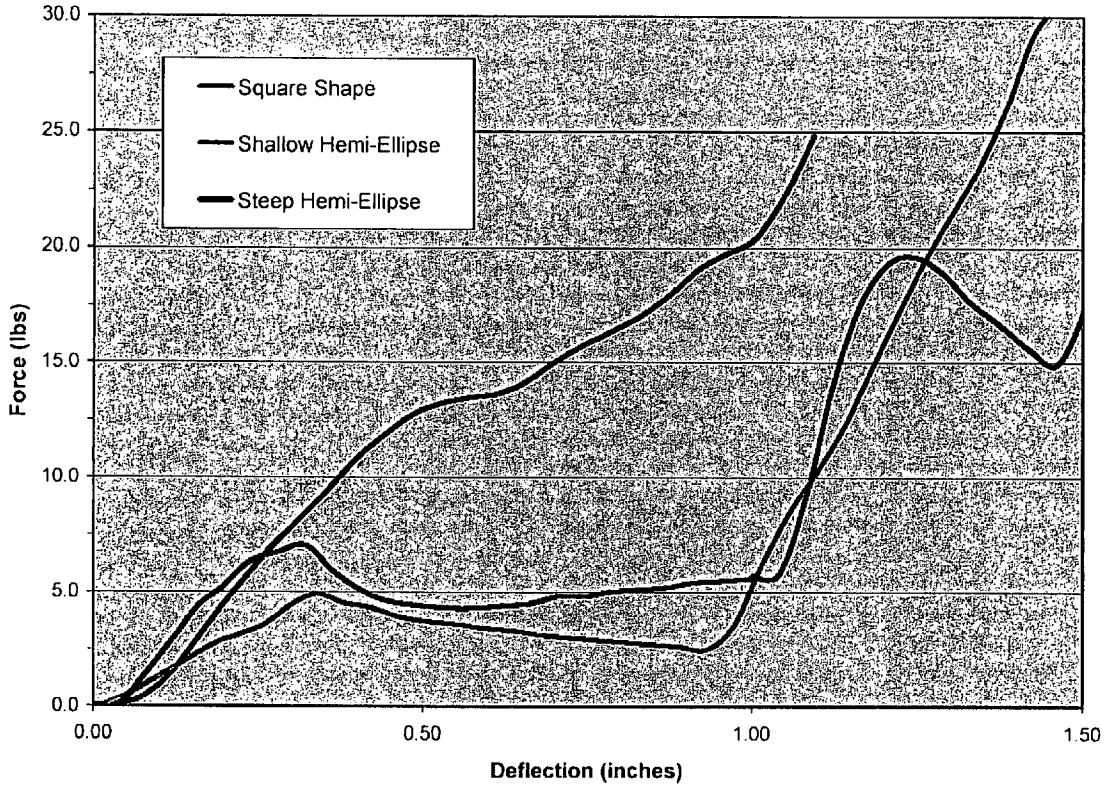
FIG. 11 is a graph depicting force versus deflection curves for various SKYDEX cushioning materials.

FIG. 11 is a comparison of force versus deflection curves for two different hemi-ellipse SKYDEX materials and a square type SKYDEX spring. It is apparent from FIG. 11 that the square profile SKYDEX spring more nearly approximates a linear force vs. displacement response than does a hemi-ellipse profile SKYDEX spring.

Figure 12:
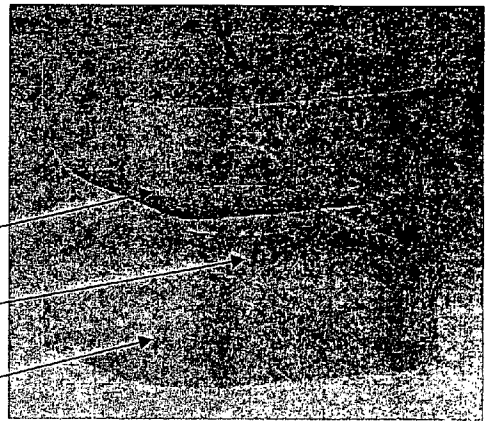
FIG. 12 is a partially transparent [phantom], perspective view of a square SKYDEX spring having an imbedded hemi-ellipsoid projection for added stiffness.

FIG. 12 illustrates some engineering variables that may be selected for tuning square profile SKYDEX material to provide a desired response. The variables include: the material type; the thickness of the material; the size of the square projections; the height of the projections; the radius of the mating surfaces of the projections; the radii on the [side] corners of the projections; and, the optional presence of an imbedded hemi-ellipsoid projection at or near the center of the square projections for added stiffness.

Figure 13:
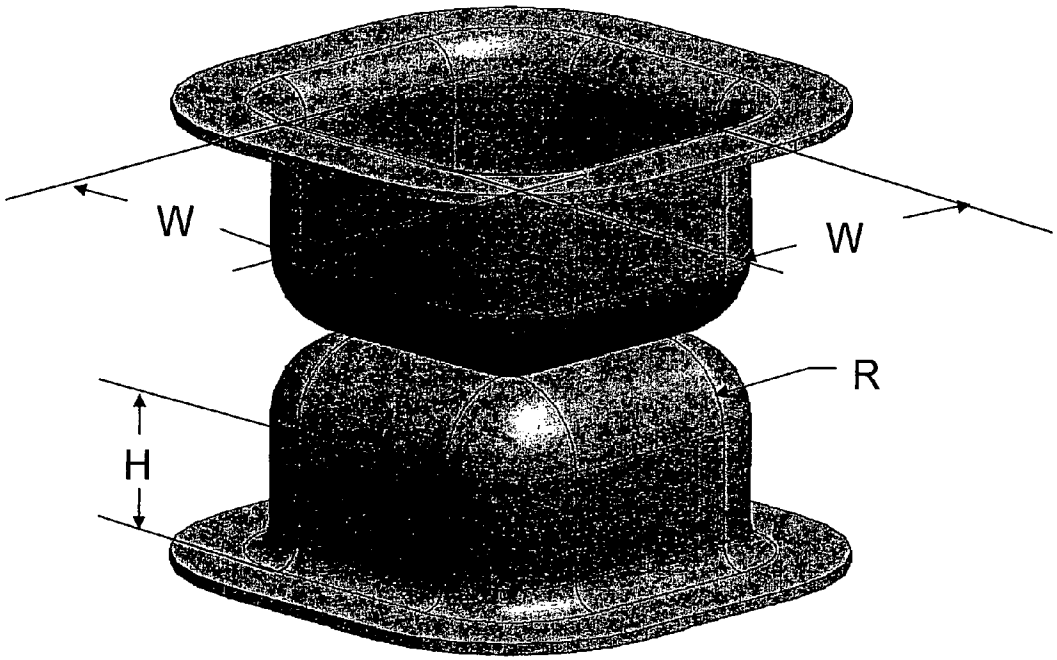
FIG. 13 illustrates the various dimensions of a square-type SKYDEX material whose values are varied in the examples of FIGS. 14-16.

FIG. 13 shows the various dimensions of a sample of square-type SKYDEX material whose values may be varied to affect the response of the material to deflection. In certain embodiments, it may be desired to adjust these variables so as to achieve a nearly linear force versus displacement response.

FIG. 14 shows the force versus displacement curves for four different samples of square-type SKYDEX material having differing values of wall height and joining radius R (as shown in FIG. 13). In each sample, the dimension W (FIG. 13) was held constant at 1.00 inch. As is apparent from the graph, the response of the Square 2 sample was the most nearly linear of the group. The dimensions for Square 2 were increased proportionately to a larger square shape having dimension W=2.0 inches. The force versus displacement of the 2-inch square-type SKYDEX material for two different material thickness values is shown in FIG. 15. As may be seen in FIG. 15, film thickness is another variable that should be taken into consideration when tuning the material for the desired force versus displacement response.

FIG. 16 illustrates the force versus deflection response of a third embodiment of the square-type SKYDEX material having the dimensions: W=1.25 inches; H=0.47 inch; and, R=0.28 inch (as illustrated in FIG. 13). The response of two different embodiments having different material thickness values is shown. Both nearly approximate a linear response curve.

While the present invention has been described with respect to a limited number of embodiments, those skilled in the art will appreciate numerous modifications and variations therefrom. It is intended that the appended claims cover all such modifications and variations as fall within the true spirit and scope of this present invention.

The invention claimed is:

1. A cushion comprising:

(a) a first surface made of flexible high polymer resin;

(b) a second surface made of flexible high polymer resin, in at least partially coextensive relation to said first surface to define a cavity therebetween, said coextensive relation defining opposing corresponding portions of said first and second surfaces;

(c) a plurality of support members comprising inwardly directed indentations in both of said first and second surfaces extending into the cavity, a plurality of the indentations in each of the first and second surfaces having a square shape and an outwardly facing recess, a plurality of the indentations in said first surface abutting said indentations in the second surface;

(d) a layer of visco-elastic foam substantially overlying the first surface; and, (e) a fabric enclosure surrounding the first surface, the second surface and the foam layer.

2. A cushioning component comprising:

(a) a top surface made of flexible high polymer resin;

(b) a bottom surface made of flexible high polymer resin, in at least partially coextensive relation to said top surface to define a cavity therebetween, said coextensive relation defining opposing corresponding portions of said top and bottom surfaces;

(c) a plurality of support members comprising inwardly directed indentations in both of said top and bottom surfaces extending into the cavity, a plurality of the indentations in each of the top and bottom surfaces being substantially square in cross section and having an outwardly facing recess, a plurality of the indentations in said top surface abutting said indentations in the bottom surface.

3. A cushioning component as recited in claim 2 wherein the force required to compress the cushioning component is a substantially linear function of the deflection comprising the compression.

4. A cushioning component as recited in claim 2 wherein the indentations comprise a substantially planar surface opposite the outwardly facing recess.

5. A cushioning component as recited in claim 2 wherein the indentations comprise two pairs of opposing walls with a rounded section joining each wall to an adjacent wall.

6. A cushioning component as recited in claim 5 additionally comprising a substantially planar surface opposite the outwardly facing recess with a rounded section joining each wall to the substantially planar surface.

* * * * *

UNITED STATES PATENT AND TRADEMARK OFFICE

CERTIFICATE OF CORRECTION

PATENT NO. : 7,574,760 B2
APPLICATION NO. : 11/326122
DATED : August 18, 2009
INVENTOR(S) : Foley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 754 days.

Signed and Sealed this

Seventh Day of September, 2010

David J. Kappos

David J. Kappos
*Director of the United States Patent and Trademark Office*